United States Patent [19]

Walter et al.

[11] Patent Number: 4,485,789

[45] Date of Patent: Dec. 4, 1984

[54] FUEL INJECTOR WITH INNER CHAMBER VACUUM

[75] Inventors: Richard P. Walter, Southfield; Lael B. Taplin, Union Lake, both of Mich.

[73] Assignee: The Bendix Corporation

[21] Appl. No.: 288,730

[22] Filed: Jul. 31, 1981

[51] Int. Cl.[3] ..... F02B 3/00; F02M 41/02

[52] U.S. Cl. ..... 123/467; 123/447

[58] Field of Search ..... 123/446, 447, 449, 467, 123/516, 506; 239/89, 90, 91, 92, 533.5, 95; 417/462

[56] References Cited

U.S. PATENT DOCUMENTS 4,372,272 2/1983 Walter et al. ..... 123/467

4,426,977 1/1984 Taplin et al. ..... 123/446

*Primary Examiner*—Charles J. Myhre

*Assistant Examiner*—Carl S. Miller

*Attorney, Agent, or Firm*—Markell Seitzman; Russel C. Wells

[57] ABSTRACT

A fuel system for a diesel engine incorporating a distributor pump for controlling the operation of a plurality of fuel injectors. Each injector comprising a housing having situated therein an intensifier piston. The housing and intensifier piston cooperate to create a plurality of variable volume chambers including an upper, middle and metering chamber. The fuel injector incorporates a means entrapping a quantity of fuel during the injection mode of operation means for forming a vacuum pressure within the middle chamber to reduce the trapped fuel to its vapor pressure after the metering mode of operation has begun to ensure that the actual pressure intensification is nearly equal to the theoretical intensification ratio by minimizing unnecessary losses.

20 Claims, 6 Drawing Figures

FUEL INJECTOR WITH INNER CHAMBER VACUUM

BACKGROUND AND SUMMARY OF THE INVENTION

This invention relates to fuel injectors for diesel engines and more particularly to a fuel injector having a metering and an injection mode of operation and an intensifier piston which defines an upper chamber, a middle chamber and a metering chambering wherein the motion of the piston cooperates to selectively maintain a vacuum or low pressure level within the middle chamber.

Diesel fuel injection systems often require that the fuel to be injected into the respective cylinders of the diesel engine be at pressures that may be in excess of 15,000 psi. Fuel systems which pressurize the fuel carrying components, upstream of the injector, at high pressure levels exhibit fuel leakage and engine horsepower drain. It is known that by utilizing injectors having an intensifier piston permits operation at lower upstream pressures. As an example, if it has been determined that the injection pressure of the fuel injector must be 18,000 psi, an intensifier piston having an intensification ratio of 3:1 would reduce the pump requirements from 18,000 to 6,000 psi. One such fuel system incorporating an intensifying piston is disclosed by Walter et al in the commonly assigned patent application U.S. Ser. No. 217,297, filed Dec. 17, 1980 now U.S. Pat. No. 4,426,977.

Broadly speaking, an intensifier piston includes a large face area upper body portion or member connected to a smaller face area lower body portion member. The intensifier piston is reciprocally situated, in form fitting contact, within a stepped bore of the injector housing. The geometry of the intensifier piston, as well as its reciprocating motion within the injector housing, define an upper chamber, proximate to and above the upper body portion. The upper chamber is adapted to receive pressurized fuel which is transmitted to a first pressure receiving surface of the upper member. The piston and housing also form a middle chamber that is situated between the upper portion and the large diameter portion of the stepped bore. A metering chamber is situated below a second pressure receiving surface on the lower body portion of the intensifier piston. During the operation of this type of injector, pressurized fuel is transmitted to the upper receiving surface of the intensifier piston, because of the relationship of the areas of the first and second pressure receiving surfaces, the intensifier piston inherently performs a pressure amplification function. The theoretical value of the intensification ratio is determined by the ratio of the areas of the first and second pressure receiving surfaces. As will be discussed below, the effective intensification ratio of these injectors is often less than the theoretical ratio.

Walter et al in U.S. Ser. No. 217,297, further incorporates a laminar flow restrictor situated in a piston. The purpose of this restrictor is to restrict the fluid flow from a downstream accumulator back into the upper chamber. The restrictor also permits the piston to move upward as the pressure above the piston is reduced due to the operation of a cooperating fuel pump.

It has been found that the injector of Walter et al and similar injectors display an injection pressure which is less than expected. The reduction of the injection pressure arises because of inefficiencies in its operation due to the additional work necessary to compress fuel within the middle chamber and also because of the additional work lost by pumping fluid through long lines between the injector and the fuel tank. This work generates unwanted heat within the fuel injector and drains needed horsepower from the engine.

These deficiencies are solved by the present invention by trapping a small amount of fuel under the primary or upper body member or portion of the intensifier piston so that as the intensifier piston rises during its metering mode of operation, the fluid pressure within the metering chamber is dropped to its vapor pressure. Consequently, during a subsequent injection mode of operation, there is no fliud to be pumped out of this chamber or to be compressed and therefore, no unnecessary work is expended. The invention further utilizes a check valve which prevents unwanted fluid from entering the middle chamber. The check valve further serves to restrict the flow of fuel from an accumulator into the upper chamber thereby creating a pressure differential across so that the metering mode of operation can start promptly.

More specifically, the fuel injector comprises a housing having a first port that is adapted to receive pressurized fuel from a first pressure source and a second port which is similarly adapted to be connected to a second source of pressurized fuel which is generally maintained at a pressure level less than the pressure level of the first source. The housing further includes a stepped bore having a larger first bore that is linked to a narrower second bore. The housing additionally includes a first dump port situated on the first bore and a second dump port that is situated on the second bore. An intensifier piston that is responsive to the pressure differential thereacross is provided for reciprocatively moving within the stepped bore and for selectively uncovering the first and the second port. The intensifier piston and the stepped bore cooperate to provide a plurality of variable volume chambers such as an upper or primary chamber, a middle or an inner chamber and a lower or metering chamber. The injector further includes a nozzle which extends from the housing and is operatively connected in fluid communication with the lower or metering chamber for injecting a predetermined quantity of fuel therefrom in correspondence with a motion of the intensifier piston. The fuel injector further includes a first fuel passage which connects the second port with the lower chamber having positioned therein a first check valve to inhibit the flow of fuel from the lower chamber through to the second port. The injector additionally contains a second fuel passage which connects the middle chamber to the second dump port and a third fuel passage having lodged therein a second check valve for inhibiting the flow between the second port and the first port. In addition, the fuel injector housing further includes a fourth fuel passage for connecting the first port to the middle chamber.

It is an object of the present invention to improve the efficiency of operation of diesel fuel injectors having intensifier pistons. It is a further object of the present invention to provide a fuel injector having a middle chamber that is selectively maintained at a low or vacuum pressure. It is a further object of the present invention to provide a fuel injector of simple construction and one that does not require sophisticated manufacturing operations.

It is a further object of the present invention to provide a diesel fuel injector having an effective intensification ratio which approximates the theoretical intensification ratio. A further object of the present invention is to provide a fuel injector having an injection and metering mode of operation which is characterized by a rapid transition between the modes of operation.

A feature of the present invention is the creation of a vacuum pressure within the inner or middle chamber. This vacuum pressure is not formed until the metering mode of operation has begun. More specifically, a small amount of fuel is trapped within the middle chamber during the injection mode of operation. During the metering mode of operation, that is, when the piston is caused to rise, the fluid pressure within this chamber is dropped to its vapor pressure. Consequently, during subsequent injection modes of operation, that is, when the intensifier piston is moving downward, no work can be expended in compressing fluid or in pumping fluid out of the middle chamber and therefore, no unwanted pressure forces are developed which tend to reduce the intensification ratio.

An advantage of the present invention is that it may be packaged and adapted to all sizes of diesel engines with virtually no engine modification. By increasing the efficiency of operation of the injector, the size and the flow capacity of cooperating distributor pumps, which supply fuel to each of the injectors, is correspondingly reduced.

According to the specific embodiment illustrated in the drawings of this application and discussed in detail below, the present invention comprises:

DETAILED DESCRIPTION OF THE DRAWINGS

Figure 1:
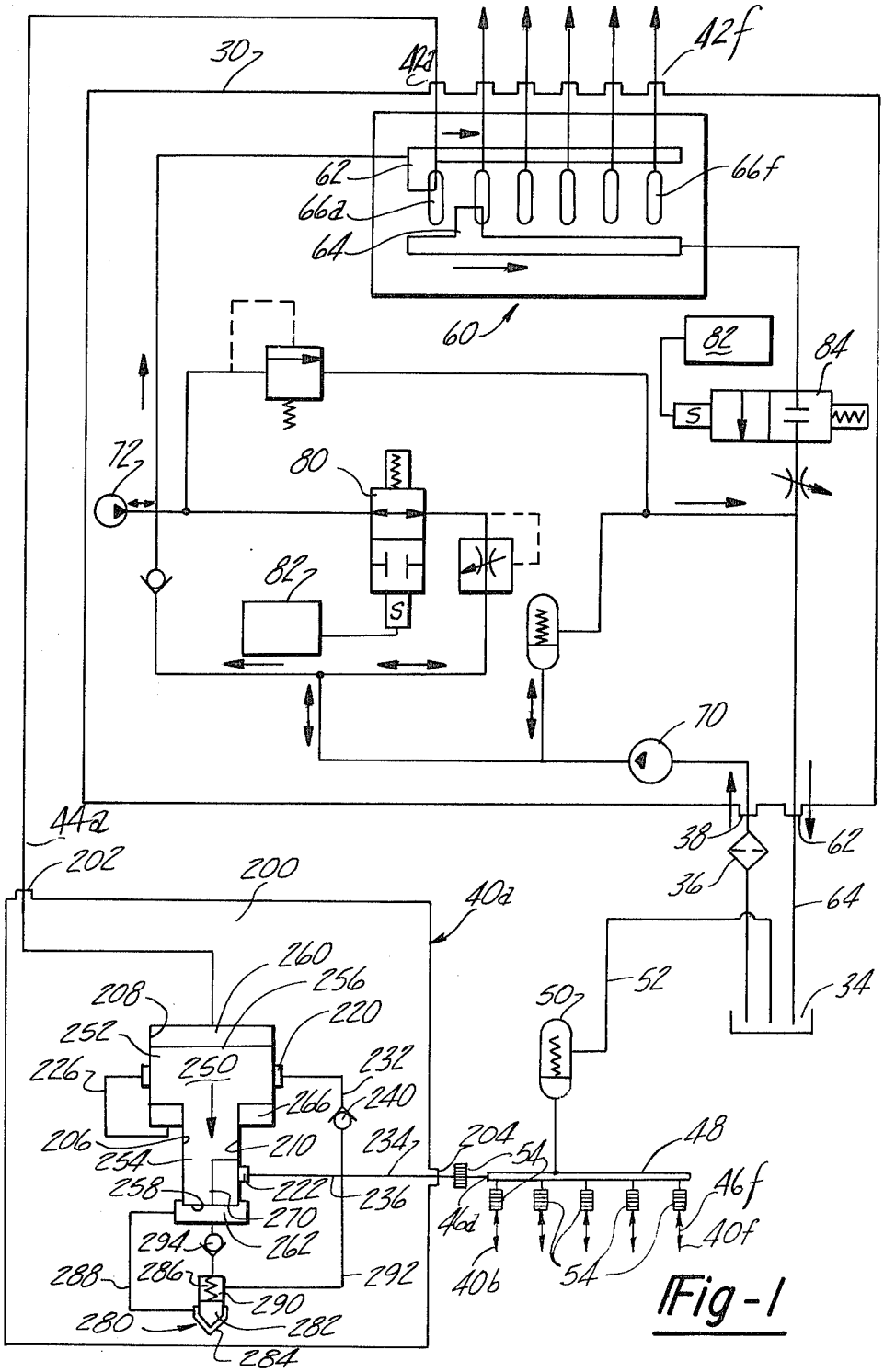
FIG. 1 is a hydraulic schematic diagram of a fuel delivery system incorporating features of the present invention.

Reference is now made to FIG. 1 which illustrates a detailed hydraulic schematic diagram of an electrically controlled fuel system for diesel engines. More specifically, there is shown a dual solenoid distributor pump 30 that is driven by the diesel engine (not shown). One such pump is disclosed by Walter et al in the commonly assigned patent application U.S. Ser. No. 217,297, filed Dec. 17, 1980 and is expressly incorporated by reference. The distributor pump 30 is connected to a liquid reservoir such as the fuel tank 34 through a fuel filter 36. Fuel is received at an input port 38. The distributor pump 30 is further adapted to communicate with a plurality of injectors 40*a–f* through output ports 42*a–f*. Each injector 40 includes a housing 200 that is adapted to connect with and receive fuel through one of the bi-directional injection lines 44*a–f* through a bi-directional first port 202. Each injector housing further has a bi-directional second port 204 which is adapted to connect to another source of pressurized fuel. In particular, the second port 204 is connected to a low pressure accumulator 50 through the accumulator or pressure lines 46*a–f* and a common line or manifold 48. The manifold 48 is connected to the accumulator and a relief valve 50 through a laminar flow restrictor 54 for each injector. The output of the accumulator 50 is connected via the pressure return line 52 to the reservoir or fuel tank 34.

Inasmuch as the fuel injection system may be configured with any number of fuel injectors, it is necessary to distribute the output of the injection pump 30 to the appropriate injectors 40*a–f*. This is accomplished by utilizing the distributor valve 60. The distributor valve comprises two distribution slots 62 and 64 which are selectively placed into communication with a plurality of openings 66*a–f*. The openings are maintained in fluid communication with the respective output portions 42*a–f* of the distributor pump. Further, details of the pump 30 are discussed in U.S. Ser. No. 217,297. Other major components of the distribution pump are a transfer pump 70 which is used to feed an injection pump 72. The output of the injection pump is directed to the distribution valve 60 which selectively pressurizes the fuel injections 40*a–f* in time sequence with the combustion process within the engine in correspondence with the opening and closing of the timing valve 80 which is controlled by the electronic control unit, ECU 82. The pump 30 fluid includes a metering valve 84 which is controlled by the ECU 82 which periodically connects the distribution valve 60 to the fuel reservoir 34.

To initiate fuel injection, the timing valve 80 is closed in response to timing signals generated by the ECU 82 and the total output of the injection pump is diverted through the distribution slot 62 and in a specific fuel injector 40. After the timing valve is closed, the fluid in the distribution slot 62 to a particular injection line 44, is compressed by the action of the injection pump and a pressure pulse is transmitted down the injection line 44 thereby activating the particular injector and causing a determinable quantity of fuel that was previously stored or premetered in its metering chamber to be injected into the engine.

Reference is again made to the distribution slot 64 of the distributor valve 60. The distribution slot 64 is situated relative to the distribution slot 62 such that it leads the motion of the distribution slot 62. This is necessary since, as mentioned above, a quantity of fuel must first be placed or pre-metered into a particular injector 40 prior to the time that a pressure pulse is developed by the injection pump 72 due to the closing of the timing valve 80.

To initiate the metering mode operation, the metering valve 84, which is normally closed, is opened, in response to signals generated by the ECU 82, thus connecting a specific injection line 44*a–f* to the fuel reservoir to relieve the pressure within that specific injection line.

Reference is now made to the hydraulic schematic diagram of a typical injector which is shown in the lower left-hand portion of FIG. 1. Inasmuch as the communication and operation of the distributor pump 30 with respect to each of the fuel injectors 40*a–f* is identical, the following description is directed to the interrelationship between the distributor pump and the fuel injector 40*a*. In addition, where appropriate, the letters designating the plurality of injectors, i.e., letters *a–f*, will not be included in the following discussion. Each injector 40 comprises a housing 200 that is adpated to receive pressurized fuel from a first source such as the pump 30. This pressurized fuel is received at the input or first port 202. In addition, each injector is further adapted to receive pressurized fuel from a second source of pressure at the second input port 204. The housing 200 includes a stepped bore 206 having received therein a intensified piston 250. The bore 206 and piston 250 cooperate to define an upper, middle and lower variable volume chambers 260, 266 and 262, respectively. The stepped bore comprises an upper first bore 208 and a lower narrower second bore 210. The housing further includes a first dump 220 port fabricated within the walls of the upper bore 208. A second dump port 222 is fabricated within the walls of the seocnd or lower bore 210 passage. A fluid passage 226 connects the middle chamber 266 to the first dump port 220. In the preferred embodiment of the invention, the first dump port 220 may comprise an annular cut-out circumscribing the walls of the upper or first bore 208. The first dump port 220 is connected to the fluid passages 232 having inserted therein a check valve 240 which is connected such that fluid flow from the second port 204 through to the first dump port 220 is restricted. The second dump 222 is also connected to the second port 204 through the fluid passage 236 and 234.

The intensifier piston 250 is tightly and reciprocatively received within the stepped bore 206. The intensifier piston 250 includes an upper member of portion 252 that may be integrally formed with a lower narrower member 254. The upper member 252 contains a pressure receiving surface 256. The lower member 254 contains another pressure receiving surface 258. As previously mentioned, the intensifier piston in cooperation with the stepped bore 206, cooperates to provide a number of variable volume chambers such as the upper or primary chamber 260, the lower or metering chamber 262, and the middle or inner chamber 266. The intensifier piston 250 further includes a fluid passage 270 having one end which intersects the pressure receiving surface 258 and another end which terminates at a wall of the lower member 254. The termination of the fluid passage 270 at the wall of the lower member 254 is so configured as to connect the lower or metering chamber 262 to the dump port 222 when the intensifier piston 250 moves downward by a determinable amount. The dimensions of the upper member 252 are such that the upper pressure receiving surface 256 of the intensifier piston 250 will uncover a portion of the dump port 220 at a determinable amount of downward travel of the intensifier piston thus communicating the upper chamber 260 to the port 220.

The injector 40 further includes a nozzle means 280 having a plunger 282 that is reciprocatively situated relative to the orifice(s) 284 and which is nominally biased to close the orifices 284 by a biasing spring 286. The nozzle means 280 is connected to the lower chamber 262 by a fluid passage 288. The biasing spring 286 is situated within a fluid receiving chamber 290. The fluid receiving chamber 290 is connected to the port 204 via the fluid passage 292 and to the lower chamber through the check valve 294 which is connected to inhibit the flow from the lower chamber 262 into the fluid receiving chamber 290.

The operation of the fuel injection system is discussed in greater detail below with the aid of FIG. 2. The distributor pump 30 and more specifically, the transfer pump 70 and the injection pump 72 are driven by the engine. The transfer pump extracts fluid from the fluid reservoir or fuel tank 34. The output pressure of the transfer pump 70 is maintained at a relatively low pressure such as 200 psi. After the injection pump 72 is filled, excess fluid is returned to the reservoir 34.

The timing valve 80 during non-injection mode periods is normally maintained in an open position during which time the distribution slot 62 is maintained at the output pressure of the injector pump 72. During this time, one of the lines 44 and the upper chamber 260 of a particular injector 40 is also maintained at the output pressure of the injection pump. It should be recalled that the distribution valve 60 connects the injection pump 72 to only one of the injectors 40*a–f* at any time. In response to a timing signal generated by the ECU 82, the timing valve 80 is commanded to close. Upon the closing of the timing valve a pressure wave is generated and transmitted via one of the injection lines 44 such as 44*a* to an injector such as 40*a* which as illustrated in FIG. 1 is presently connected to the distribution slot 62 through opening 66*a*.

Figure 2A:
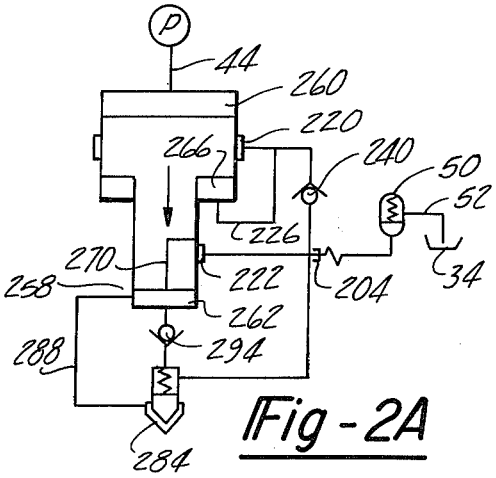
FIGS. 2A, 2B, 2C and 2D are hydraulic schematic diagrams illustrating the modes of operation of a diesel fuel injector incorporating the present invention.

As mentioned, the pressure within the fluid passages and pressure lines connected to the injection pump 72, during the intervals of time when the timing valve 80 is open, will approximately be maintained at a pressure which is not sufficient to crack open the nozzle 280. However, upon the closing of the timing valve and the generation of the pressure wave, the pressure applied to a specific fuel injector may be 2,000–6,000 psi or higher. In response to this increased pressure of fluid within the upper chamber 260, the intensifier piston 250 is caused to move downward. FIG. 2*a* illustrates the piston 250 of a particular injector 40 moving downward in response to the pressure wave created by the operation of the pump 30. As illustrated therein, the walls of the intensifier piston 250 have closed off the dump ports 220 and 222. The fluid that has been pre-metered, during a prior metering event, into the lower or metering chamber 262 is now compressed by the piston 250 to a pressure significantly higher than the pressure of the fluid in the upper chamber 260. This increase in pressure is a direct result of the intensification ratio of the piston 250 resulting from the relationship in areas of the pressure receiving surfaces 256 and 258. Fluid at this substantially higher pressure (7,500–18,000 psi) is caused to flow through the fluid passage 288 to the orifices 284 of the nozzle 280. At some predetermined pressure the nozzle 280 will open permitting fuel or fluid to be injected into a specific cylinder of the diesel engine in timed relation to the combustion process therein. The piston 250 will continue its downward motion and injection will continue until the motion of the lower member 254 places the fluid passage 270 in communication with the dump port 222. This opening of the dump port 222 permits the high pressure fuel within the metering chamber 262 and in the fluid passage 288 to be rapidly dumped through the port 222 to the accumulator 50 thus causing the pressure within the metering chamber 262 to drop therein enhancing the rapid termination of injection. This relationship is shown in FIG. 2*b*.

At this point in time the injection mode of operation is virtually completed and flow from the pump 30 is no longer required. The motion of piston 250 places the pressure receiving surface 256 in communication with the dump port 220 thereby connecting the upper chamber 260 to the low pressure accumulator 50. This action relieves the pressure in the upper chamber 260. The flow of excess fluid from the pump 30 through port 204 fills the accumulator 50 to provide a source of fuel to later be pre-metered to other injectors during their respective metering modes of operation. It should be appreciated that after each injection mode or event the pressure within the upper chamber 260 and its corresponding injection lines 44*a–f* will temporarily stabilize at the pressure determined by the accumulator 50. It should also be noted that the dumping of the pressure within the metering chamber 262 and the upper chamber 260 may be performed sequentially or simultaneously.

Figure 2B:
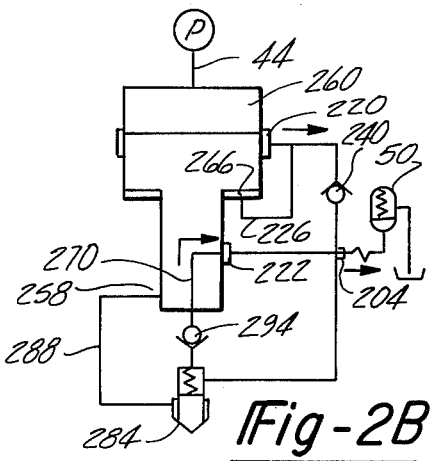

Upon termination of an injection event, the piston 250 will be positioned at the bottom of its stroke as illustrated in FIG. 2*b* with its respective injection line 44 connected to the low pressure manifold 48 and accumulator 50 via the dump port 220. The piston will remain in this position until the next metering interval.

In addition, fuel is permitted to flow from the middle chamber 266 through fluid passage 226 and to the dump port 220, thus allowing any fuel that may have leaked into the middle chamber to be dumped. This condition is also illustrated in FIG. 2*b*.

Prior to each injection event, each injector 40*a–f* must be charged or pre-metered with a specific quantity of fuel. In response to an electrical signal generated by the ECU 82, the metering valve 84 is activated and a particular injector is connected to the metering valve 84 through one of the openings 66*a–f* in the distributor valve 60. More specifically, a pulse width metering signal is generated by the ECU 82 in correspondence with the passage of the metering slot 64 across a specific one of the openings 66*a–f* within the distributor valve 60.

Figure 2C:
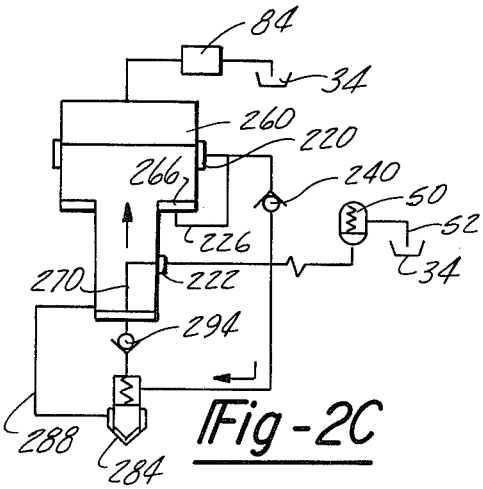

As previously mentioned, each metering event or interval is begun by opening the metering valve 84 in response to the activation signals received from the ECU 82 and ends when the metering valve is closed. The advantage of utilizing a separate valve for metering and another valve for timing permits the metering event to occur separately from that of injection thus isolating the two events. The isolation of these functions permits a greater time to meter fuel into a specific fuel injector 40 and improves the overall accuracy of the fuel metering. When the metering valve 84 is opened, the fluid near the metering valve flows through the valve causing a pressure drop in a particular line 44. As this pressure drop is transmitted down a line 44, the pressure will drop in chamber 260. The pressure below the intensifier piston in chamber 262 is set by the accumulator 50. The pressure within chamber 260 will be less than the pressure in chamber 262. This pressure differential will cause the piston to move upward. As the piston moves upward, fluid from the accumulator 50 flows into the metering chamber 262 through lines 234, 292 and through the metering check valve 294. Fluid will continue to enter the metering chamber 262 until the metering valve 84 is commanded to close; this would correspond to the removal of the activation signals transmitted from the ECU 82. FIG. 2*c* illustrates the beginning of the metering mode of operation with the piston moving upward.

It can be seen that by knowning the pressure differential of the accumulator 50 and of the fuel tank 34 and the restrictions imposed by the metering valve 170, the orifice 174 and the injection lines 44, then the flow rate of fuel out of the upper chamber 260 and also the flow into the metering chamber 262 can be determined. Consequently, by monitoring the time that the metering valve is open, the quantity of fuel permitted to flow into the metering chamber 262 can be controlled.

Figure 2D:
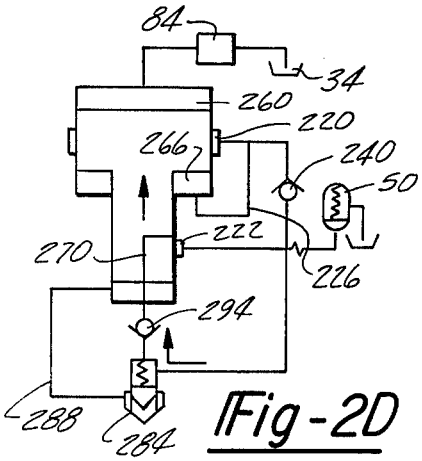

As the piston 250 moves upward, as illustrated in FIG. 2*d*, due to the filling or pre-metering of fuel to the metering chamber 262, the fluid passage 270 is moved out of communication with the dump port 222 thus terminating communication between the metering chamber 262 and dump port 222. In addition, as the piston moves upward, the upper pressure receiving surface 256 is moved out of communication with the dump port 220 therein trapping a quantity of fuel within the inner or middle chamber 266. As the piston continues to rise during the metering event, the fluid pressure of the fuel trapped within the middle chamber 266 is reduced to its vapor pressure. The metering as described is made possible by using the vacuum check valve 240. The check valve 240 is required to ensure that the fluid from the accumulator flows to the metering chamber 262 through the metering check valve 294. Without the vacuum check valve 240, there will be a direct short circuit around the intensifier piston 250 from port 204 to line 44. This short circuit would not force the piston 250 upward to start metering fluid into chamber 262.

The second purpose of the vacuum check valve 240 is to prevent fluid flow from the accumulator 50 from flowing to the middle chamber 266 so that vapor pressure will be formed in this chamber to increase the effective intensifier ratio during injection as described elsewhere.

It should be appreciated that during subsequent injection modes of operation, work must be expended in compressing the fuel with the metering chamber 262. However, as in prior art injectors, if fuel resides within the middle chamber unnecessary work must also be expended to compress the fluid. This unnecessary work is eliminated and the efficiency of the present fuel injector greatly increased by creating within the middle chamber, the reduced or vacuum pressure level.

After the metering event is completed, the distributor valve will connect the injection pump 72 to another injector 40 such as injector 40*b* which has just received its metered quantity of fuel and will initiate another injection event or interval in a manner identical to that described above.

Figure 3:
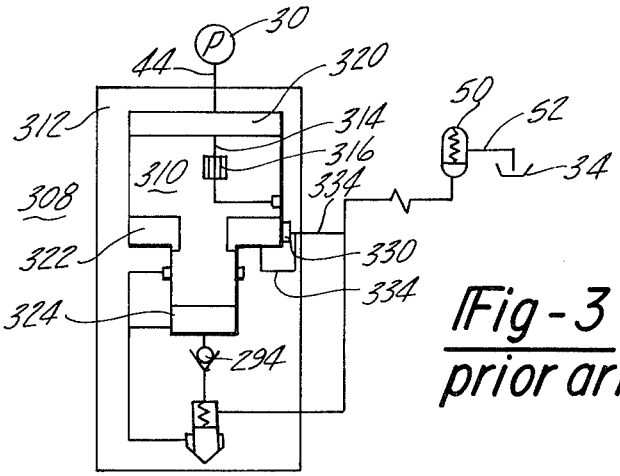
Fig-3 prior art
FIG. 3 illustrates a prior art diesel fuel injector.

Reference is now made to FIG. 3 which illustrates a prior art fuel injector 300 having an intensifier piston 310 situated within an injector housing 312. The intensifier piston includes a fluid passage 314 and a laminar flow restrictor 316 inserted therein. The motion of the piston 310 and housing 312 corporate to form three variable volume chambers. More specifically, an upper chamber 320, a middle chamber 322 and a lower or metering chamber 324. In addition to other fluid passages, a nozzle and check valve, the housing further includes a dump port 330 which is connected to the middle chamber 322 and to an accumulator 50.

The operation of fuel injector 300 is similar to the operation of the present invention. The piston 310 will begin to move downward due to the generation of pressure wave by the distributor pump 30. At some point and time, the fluid passage 314 will communicate with dump port 330, thus relieving the pressure within the upper chamber 320 by connecting the upper chamber 320 to the lower pressure accumulator 50. It can be appreciated that with the injector in its lower position, fuel will flow from the upper chamber the accumulator 50 through the dump port 330.

During the metering mode, that is when the pressure in the upper chamber 320 is reduced to a level below that of the pressure level established by the accumulator 50, the intensifier piston 310 will move upward. The laminar restrictor 316 is required to prevent the flow from the accumulator 50 from not flowing directly into line 44, and to flow through the metering check valve 294 into chamber 324. As the piston 310 moves upward, fluid from the accumulator 50 will continue to flow into the middle chamber 322 through line 334.

During a subsequent injection mode of operation, i.e., when the piston 310 is caused to move downward due to the increased pressure generated in the upper chamber 320, the piston must of course compress the fluid within the metering chamber 320 to initiate injection. However, the piston must also compress and overcome the reactive forces due to the fuel within the middle chamber 322 which must be forced out of the middle chamber through line 334. The work expended to compress and to force the fluid out of the middle chamber 322 is a direct cause of the inefficiencies present in this prior art fuel injector and is overcome as previously indicated by the present invention. In addition, the laminar restrictor 314 which is generally an expensive item is replaced in the present invention by an inexpensive check valve 240 which serves the dual purpose of creating the vapor pressure in the middle chamber 266 as well as having metering start promptly by eliminating the short between lines 204 and 44.

Many changes and modifications in the abovedescribed embodiment to the invention can, of course, be carried out without departing from the scope thereof. Accordingly, that scope is intended to be limited only by the scope of the appended claims.

Having thus described the invention, what is claimed is:

1. A fuel injector having metering and injection modes of operation and adapted to receive fuel from a first and a second source of pressurized fuel for injecting a pre-metered quantity of fuel into a diesel engine comprising:

a housing having a first port adapted to communicate with the first pressure source and a second port adapted to communicate with the second pressure source;

intensifier piston means reciprocatively received within said housing for defining an upper, a middle and a lower variable volume chamber therebetween; and means for permitting a predetermined first quantity of fuel to be received within said middle chamber during the injection mode of operation, and for reducing thereafter the pressure level of said first quantity of fuel within said middle chamber to a first pressure level and for pressurizing said first quantity of fuel during said injection mode of operation.

2. The fuel injector as defined in claim 1 wherein said first pressure level corresponds to the vapor pressure level of said first quantity of fuel.

3. A fuel injector having metering and injection modes of operation comprising:

a housing adapted to receive fuel at a determinable first pressure level at a bi-directional first inlet port and further adapted to receive fuel at another pressure level at a bi-directional second inlet port;

intensifier piston means, having a first pressure receiving surface exposed to fuel at said first pressure level and a second pressure receiving surface exposed to fuel at said another pressure level, for reciprocatively moving within said housing in response to the pressure differential thereacross, and for establishing, in cooperation with said housing variable volume chambers including an upper chamber, connected to said first inlet port, and situated above said first pressure receiving surface, a lower chamber connected to said second inlet port and situated below said second pressure receiving surface and a middle chamber situated therebetween, and for compressing the fuel within said lower chamber at a pressure determined by the ratio of the areas of said first and said second pressure receiving surfaces;

first means for establishing a determinable level of vacuum fuel pressure within said middle chamber during the metering mode of operation in correspondence with the motion of said intensifier means; and nozzle means in fluid communication with said lower chamber, for injecting fuel therefrom in correspondence with the motion of said intensifier piston means during the injection mode of operation.

4. The fuel injector as defined in claim 3 wherein said first means includes means for introducing a determinable quantity of fuel into said middle chamber prior to the beginning of the metering mode and includes means for expanding the volume of said middle chamber during said metering mode to reduce the pressure therein to the vapor prssure of the fuel.

5. The fuel injector as defined in claim 4 wherein said means for expanding includes said second receiving surface.

6. The fuel injector as defined in claim 5 wherein said first means further includes a first passage for selectively communicating said upper chamber to said middle chamber in correspondence with the motion of said intensifier means.

7. The fuel injector as defined in claim 6 further including:

second means for communicating said upper chamber to said second inlet port in correspondence with the motion of said intensifier means.

8. The fuel injector as defined in claim 7 wherein said second means includes a second passage, having a check valve lodged therein for starting metering promptly.

9. The fuel injector as defined in claim 8 wherein said check valve inhibits flow to said middle chamber for creating a vacuum in said middle chamber.

10. The fuel injector as defined in claim 7 further including third means connected to said second inlet port for relieving the pressure within said lower chamber to terminate the injection mode of operation, in correspondence with the motion of said intensifier means.

11. The fuel injector as defined in claim 10 wherein said third means includes a fuel passage situated within said housing and another fuel passage located within said intensifier means having one end in fluid communication with said lower chamber and having another end that is selectively brought into fluid communication with said fuel passage in correspondence with the motion of said intensifier piston means.

12. A fuel injector comprising:

a housing having a first port that is adapted to receive pressurized fuel from a first source, a second port adapted to be connected to a source of fuel pressurized at a pressure level less than the level of said first source and a stepped bore having a larger first bore linked to a narrower second bore, said housing further including a first dump port situated on said first bore, a second dump port situated on said second bore;

intensifier piston means responsive to the pressure differential thereacross for reciprocatively moving within said stepped bore, and for selectively uncovering said first dump port and said second dump port, said intensifier piston means and said stepped bore cooperating to provide a variable volume upper or primary chamber, in communication with said first port middle or inner chamber and lower or metering chamber in communication with said second port;

nozzle means, extending from said housing and operatively connected, in fluid communication, to said lower chamber, for injecting fuel therefrom in correspondence with the motion of said intensifier piston means;

first fuel passage means for connecting said second input port with said lower chamber including first check valve means for inhibiting flow of fuel from the lower chamber to said second port;

second fuel passage means for connecting said first dump port to said middle chamber;

third fuel passage means for connecting said first dump port to said second port including second check valve means for inhibiting the flow between said second port and said first dump port and said middle chamber;

and forth fuel passage means for connecting said second dump port to said second port.

13. The fuel injector as defined in claim 12 wherein said intensifier piston means comprises:

an upper cylindrical member, having a first pressure receiving surface thereon, forming the lower extreme of said upper chamber, said upper cylindrical member attached to a lower cylindrical member, forming the upper extreme of said lower chamber, said intensifier piston means further including passage means for connecting said second dump port to said lower chamber in correspondence with the motion of said intensifier piston means within said stepped bore.

14. The fuel injector as defined in claim 13 wherein said first and said second check valve means are check valves.

15. The fuel injector as defined in claim 14 wherein said nozzle means includes orifice means for permitting outflow of fuel therefrom and plunger means for selectively opening and closing said orifice means in correspondence with the fuel pressure in said metering chamber.

16. In a fuel injector having metering and injection modes of operation and adapted to receive fuel from a first source of pressurized fuel and from a second source of pressurized fuel through a flow restrictor for injecting a pre-metered quantity of fuel into a diesel engine wherein the fuel injector includes: a housing having a first port adapted to communicate with the first pressure source and a second port adapted to communicate with the second pressure source; and an intensifier piston means reciprocatively received within said housing for defining an upper, a middle and a metering variable volume chamber therebetween;

a method comprising the steps of:

permitting a determinable amount of fuel to be received within the middle chamber during the injection mode of operation;

reducing the pressure of the received quantity of fuel in the middle chamber, during the metering mode of operation;

introducing a determinable quantity of fuel into the metering chamber during the metering mode of operation;

pressurizing the upper chamber, during the injection mode of operation to cause the intensifier piston to compress the fluid within the metering chamber; and ejecting fuel from the metering chamber.

17. The method as defined in claim 16 wherein said step of reducing includes reducing the pressure of the received quantity of fuel to its vapor pressure.

18. The method as defined in claims 16 and 17 wherein the step of ejecting is performed prior to or at the time that fuel vapor within the middle chamber is caused to return to a liquid state.

19. In a fuel injector having metering and injection modes of operation and adapted to receive fuel from a first source of pressurized fuel and from a second source of pressurized fuel through a flow restrictor for injecting a pre-metered quantity of fuel into a diesel engine a method comprising the steps of:

premetering a first determinable quantity of fuel into the metering chamber during a metering mode of operation;

compressing the fuel within the metering chamber during the injection mode to a pressure level sufficient to cause injection of fuel from the fuel injector;

causing a second determinable quantity of fuel to enter the middle chamber, prior to the termination of the inspection mode of operation;

relieving the pressure above the intensifier piston to cause the intensifier piston to move upward and again permit the premetering of the determinable quantity of fuel to enter the metering chamber;

entrapping the second determinable quantity of fuel within the middle chamber; and reducing the pressure level of the fuel within the middle chamber to its vacuum pressure prior to the next injection mode of operation creating a back pressure in the middle chamber.

20. The method as defined in claim 19 wherein the step of reducing includes increasing the volume of the middle chamber.

* * * * *